US005363676A

United States Patent [19]

Tsuchiya

[11] Patent Number: 5,363,676

[45] **Date of Patent: * Nov. 15, 1994**

[54] DUST SUCKING AND DISCHARGING DEVICE FOR FIBER WASTES ON KNITTING MACHINE

[75] Inventor: Koji Tsuchiya, Hyogo, Japan

[73] Assignee: Precision Fukuhara Works, Ltd., Hyogo, Japan

[ * ] Notice: The portion of the term of this patent subsequent to Jan. 12, 2010 has been disclaimed.

[21] Appl. No.: 24,508

[22] Filed: Mar. 2, 1993

[30] Foreign Application Priority Data

Apr. 2, 1992 [JP] Japan ..... 4-110744

[51] Int. Cl.[5] ..... D04B 35/32

[52] U.S. Cl. ..... 66/168; 15/301; 15/345

[58] Field of Search ..... 66/168; 15/301, 345

[56] References Cited

U.S. PATENT DOCUMENTS

| | | | |
|---|---|---|---|
| 2,291,546 | 7/1942 | George | 15/301 X |
| 2,582,092 | 1/1952 | Amcet | 15/301 |
| 3,222,707 | 12/1965 | Allenbaugh | 15/345 |
| 3,546,852 | 12/1970 | Furstenberg et al. | 66/168 |
| 4,719,662 | 1/1988 | Horak et al. | 15/301 |
| 4,765,158 | 8/1988 | Goller et al. | 66/168 |
| 4,905,340 | 3/1990 | Gutschmit | 15/345 X |
| 5,008,972 | 4/1991 | Steimike | 15/345 X |
| 5,154,045 | 10/1992 | Saruwatari et al. | 15/301 X |
| 5,177,985 | 1/1993 | Igarashi et al. | 66/168 |

FOREIGN PATENT DOCUMENTS

| | | | |
|---|---|---|---|
| 485258 | 5/1992 | European Pat. Off. | 66/168 |
| 2708436 | 4/1960 | France . | |
| 1560928 | 3/1970 | Germany . | |
| 1585177 | 10/1970 | Germany . | |
| 2708436 | 7/1978 | Germany . | |
| 0510508A3 | 1/1993 | Germany . | |
| 0531919A1 | 3/1993 | Germany . | |
| 842174 | 7/1960 | United Kingdom | 66/168 |

*Primary Examiner*—Clifford D. Crowder
*Assistant Examiner*—John J. Calvert
*Attorney, Agent, or Firm*—Bell, Seltzer, Park & Gibson

[57] ABSTRACT

Fiber waste generated adjacent the knitting section and the yarn feeding members of the machine is conducted by air streams into the lower end of a first duct extending upwardly from the knitting section. The air and therein entrained fiber waste passes from the upper end of the duct and then sequentially through a laterally extending second duct and a vertically extending third duct to a waste collection box. The third duct is made of flexible fabric, vinyl or similar material having therein a multiplicity of small openings that permit lateral passage of air from the duct, while restricting lateral passage of fiber waste from the duct. A funnel-shaped member within the collection box compacts the waste entering the box. The first duct has vertically aligned sections that are telescopically adjustable.

20 Claims, 5 Drawing Sheets

DUST SUCKING AND DISCHARGING DEVICE FOR FIBER WASTES ON KNITTING MACHINE

Some of the subject matter of the subject application is also disclosed in commonly owned U.S. patent application Ser. No. 07/940,512, filed Sep. 4, 1992, and also in commonly owned U.S. patent application Ser. No. 07/869,460, filed Apr. 16, 1992.

FIELD OF THE INVENTION

This invention relates to an apparatus for collecting and removing lint, dust and similar fiber waste from components of a circular knitting machine, such as the yarn carrier, sinker, sinker cap, and needle components, and from yarn feeding and/or guiding components associated with the knitting machine.

BACKGROUND OF THE INVENTION

Over 100 yarn supply bobbins may be associated with a conventional circular knitting machine. Particularly when the yarn being knitted includes cotton fiber, the fiber waste generated by engagement of the yarn with the machine's yarn feeding, guiding and/or knitting components is quite substantial. The fiber waste problem is aggravated by the fact that knitting machines are being operated at increasingly faster speeds, which increases the rate and amount of fiber waste generation.

After fiber waste has become airborne, it may settle upon the yarn feeding and guiding devices or other components of the knitting section of the knitting machine where the fiber waste was generated, or upon one or more neighboring machines. This increases the possibility of yarn breakage, defective stitch formation, and general degradation of the quality of the knitted fabric.

Previously proposed apparatuses for removing fiber waste from circular knitting machines have employed fans or air blowers located above the machines. However, these merely displace the fiber waste from one location to another and do not collect it since fiber waste cannot be efficiently collected by merely subjecting it to a blast of air generated by a fan, blower or the like. It has also been proposed to enclose each of the knitting machines in a curtain-like sheet, and to provide adjacent each machine an exhaust duct into which a machine operator may introduce fiber waste generated by the machine and collected by the operator. Providing separate exhaust ducts in association with each of the knitting machines is quite expensive, however. Additionally, the curtain-like sheets limit access to the knitting machines, and rapidly become unsanitary due to adherence of lint, oil, dirt and the like to them.

SUMMARY OF THE INVENTION

The apparatus of the present invention includes a vertically extending first duct that closely overlies and extends upwardly from the knitting section of the knitting machine, and that has upper and lower sections that are capable of telescopic adjustive movement relative to each other. Motor driven fans produce air streams that entrain fiber waste generated adjacent the knitting section of the machine and/or adjacent the periphery of the machine. The air streams and therein entrained fiber waste pass into the lower end of the first duct, upwardly through it, and then from the duct's upper end. The air streams and entrained waste passing from the first duct are received within the upstream end of a second duct that conducts the air streams and waste laterally outwardly from the center of the machine and then to and from the duct's downstream end, which is preferably located outwardly from the periphery of the knitting machine. The air stream and entrained fiber waste passing from the downstream end of the second duct enters the upper end of a third, generally vertically extending duct having a lower end releasably connected to a fiber waste collection box. In contrast to the first and second ducts, which may be and usually are formed of metal or other non-porous and relative inflexible material, the third duct is preferably formed of flexible fabric or vinyl material having perforations or other small openings that permit lateral passage of air, while restricting lateral passage of fiber waste, from the second duct. Air and fiber waste passing from the lower end of the third duct enter the waste collection box via a funnel-shaped member that compacts the waste.

In a preferred embodiment of the invention, the first duct includes an upper section, and a lower section that mates with and is vertically and telescopically movable relative to the upper section so as to adjust the magnitude and/or velocity of the air streams passing through the duct.

DESCRIPTION OF THE PREFERRED EMBODIMENT

Figure 1:
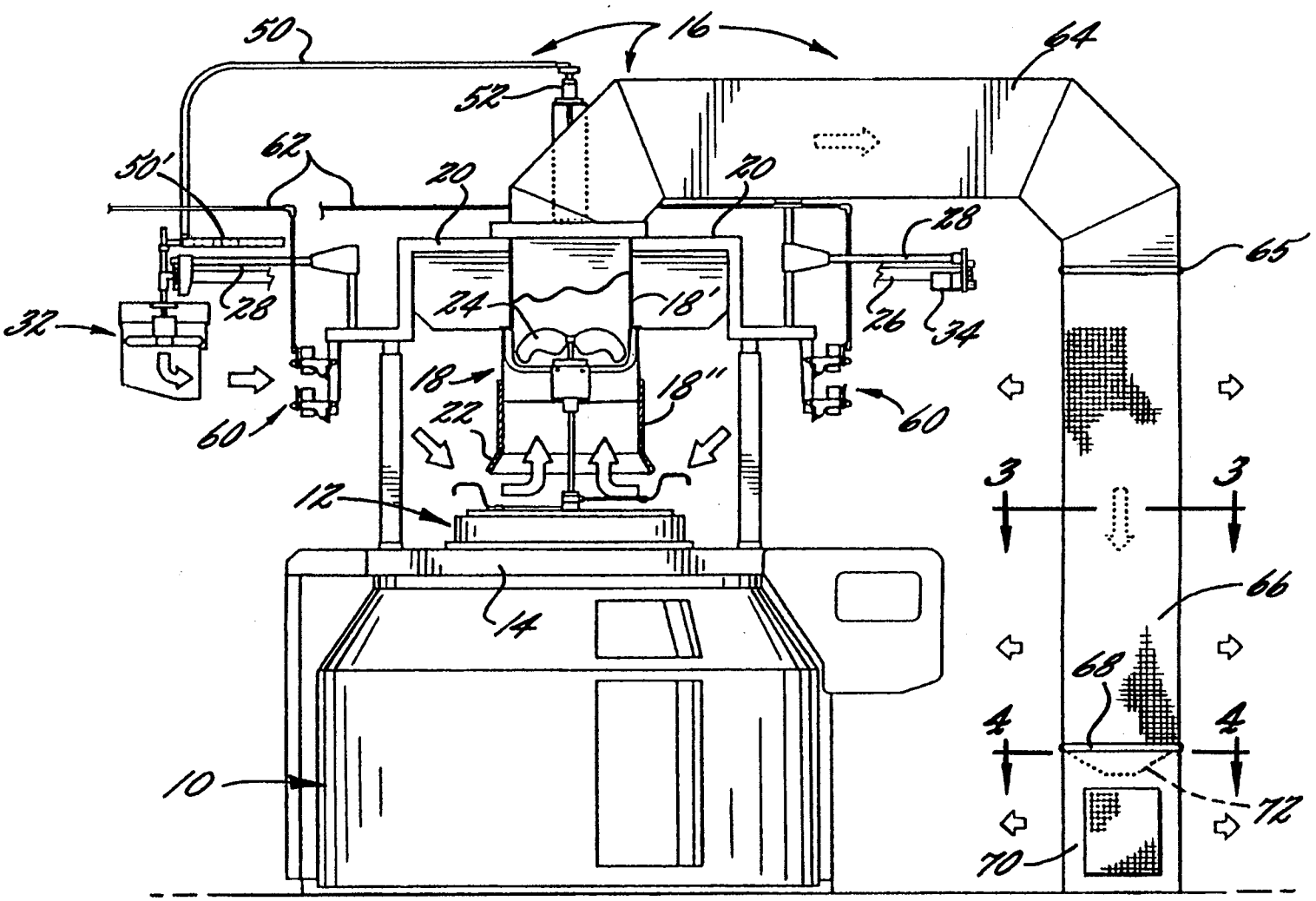
FIG. 1 of the drawings is a front elevational view of a circular knitting machine having fiber waste collecting and removing apparatus in accordance with the invention.
Figure 2:
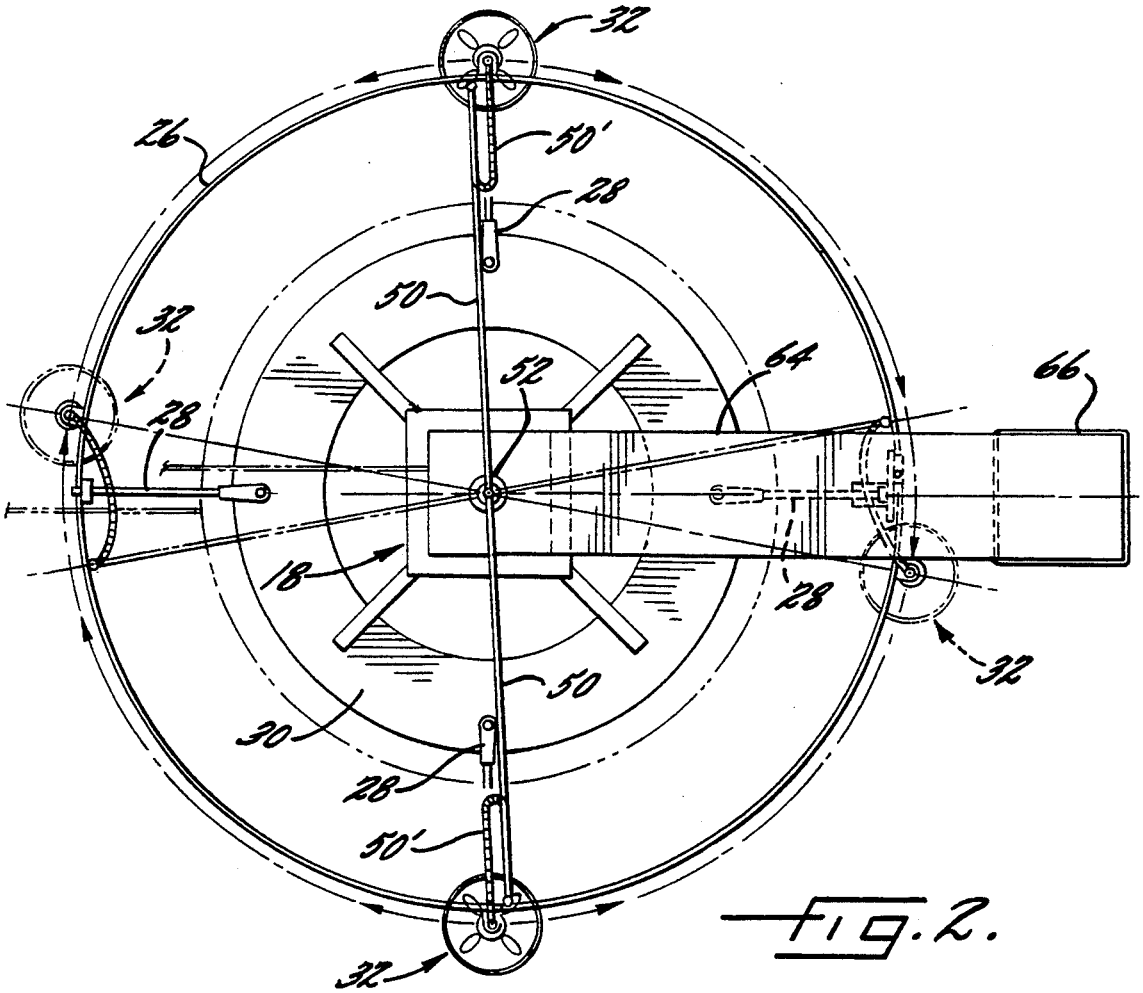
FIG. 2 is a top plan view of fan and duct components of the knitting machine and apparatus of FIG. 1.
Figure 3:
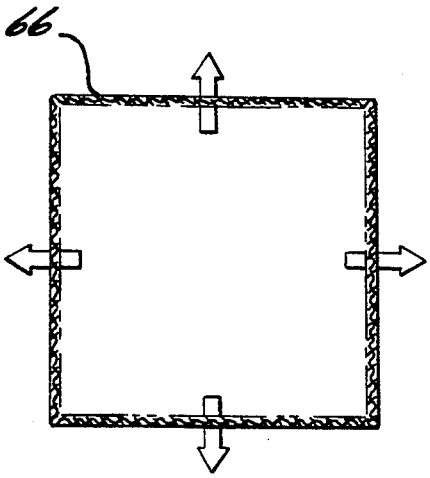
FIG. 3 is a horizontal sectional view taken approximately along the line and in the direction of the arrows 3—3 of FIG. 1 through a perforate fiber waste removing duct of the apparatus.
Figure 4:
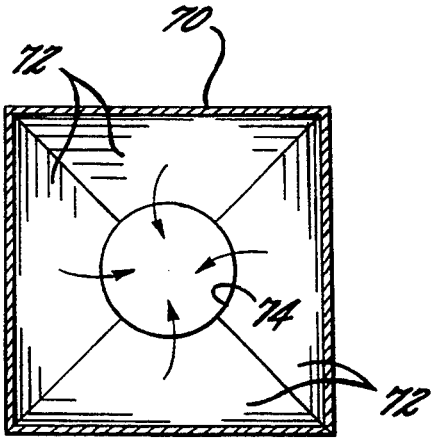
FIG. 4 is a horizontal sectional view taken approximately along the line and in the direction of the arrows 4—4 of FIG. 1 through the upper part of a fiber waste collecting box of the apparatus.

FIG. 1 of the drawings shows a circular knitting machine 10 having a knitting section 12 that extends upwardly from a bed 14. As is well known to those skilled in the art, lint, dust and similar fiber waste is generated during operation of machine be. In accordance with the present invention, such fiber waste is collected and conducted from machine be by apparatus 16 associated with machine 10. Apparatus 16 includes a duct 18 that is mounted above and in axial alignment with knitting section 12 of machine be. Duct 18 includes an upper section be' that is fixedly connected to and supported by frame members 20 of machine 10. Duct 18 further includes a coaxial lower section 18'' that resiliently mates with and is telescopically adjustable relative to upper section be'. The lower end portion of lower duct section 18'' has an outwardly flared skirt 22. A motor driven fan 24 is mounted within upper section 18' of duct 18.

Referring now also to FIGS. 2–10, as well as FIG. 1, apparatus 16 further includes an endless rotatable ring 26 that is supported in outwardly spaced adjacent relationship to the upper part of machine 10 by support members 28 that extend radially outwardly from upper frame members 20 of machine 10. A pair of motor driven fans 32 are fixedly connected to ring 26, at diametrically opposed locations thereon, for bi-directional movement with the ring between their solid line and phantom line positions shown in FIG. 2. The aforesaid rotational movement is imparted to ring 26 by drive means best shown in FIGS. 7–10. Such drive means includes a drive motor 34 mounted upon a support plate 36 extending downwardly from at least one support member 28. A drive roll 38 upon the output shaft of motor 34 supportively underlies ring 26 and, upon actuation of motor 34, imparts rotational movement to the ring 26. A guide roll 40 upon plate 36 engages the upper edge of ring 26. A cam plate 42 mounted for longitudinal sliding movement upon and relative to plate 36 is displaced between its positions shown in FIGS. 8A and 8B when engaged by a cam element 44 secured to and projecting upwardly from ring 26. Movement of cam plate 42 by cam element 44 varies the position of the cam follower 46 of a limit switch 48, which in turn causes reversal of the direction of rotation of drive roll 38 and, thus, of ring 26 and the fans 32 secured to the ring.

Electrical power is conducted to each of the fans 32 and at least one motor 34 by wiring within a conduit 50 that is connected at its inner end to a rotatable member 52 projecting upwardly from the center of the upper framework of machine 10. The outer section of each conduit 50 extends vertically downwardly and includes a flexible suction 50'.

Figure 5:
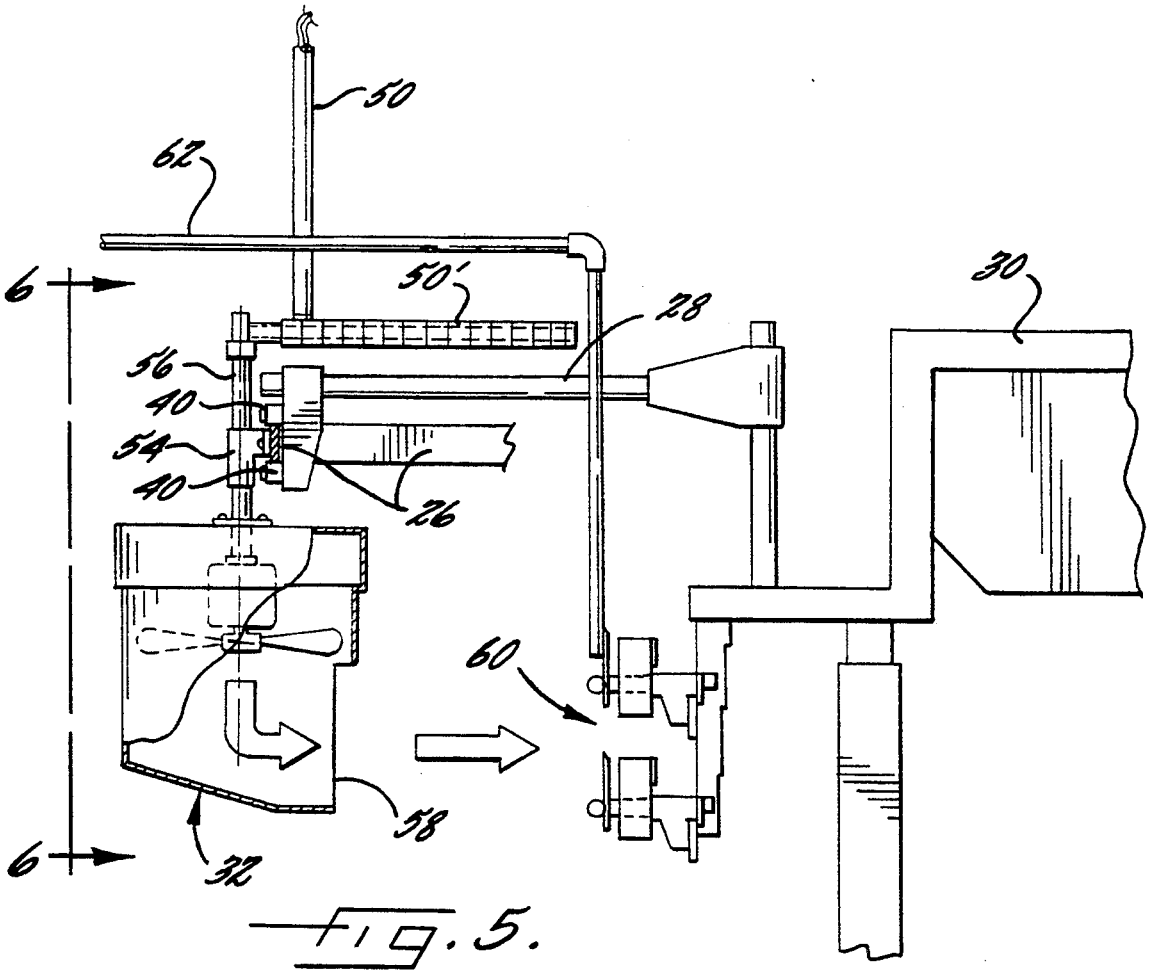
FIG. 5 is an enlarged fragmentary view of fan, yarn guide and adjacent components associated with the knitting machine, some of which are partially broken away to reveal interior details, shown in the upper left part of FIG. 1.
Figure 6:
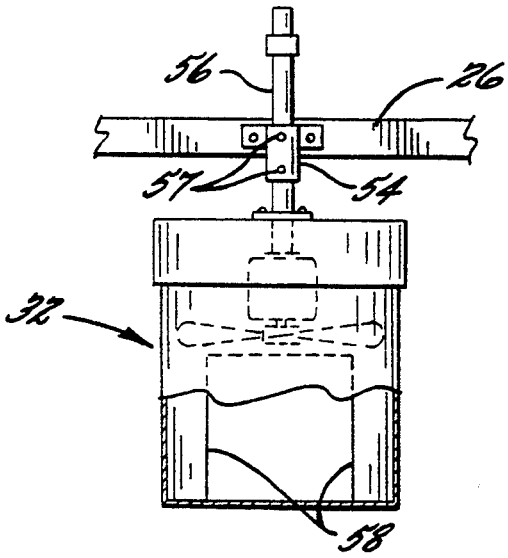
FIG. 6 is a partially broken away side elevational view taken in the direction of the arrows 6—6 of FIG. 5 of the traveling fan of FIG. 5, and of fragmentarily shown support means for such fan.
Figure 7:
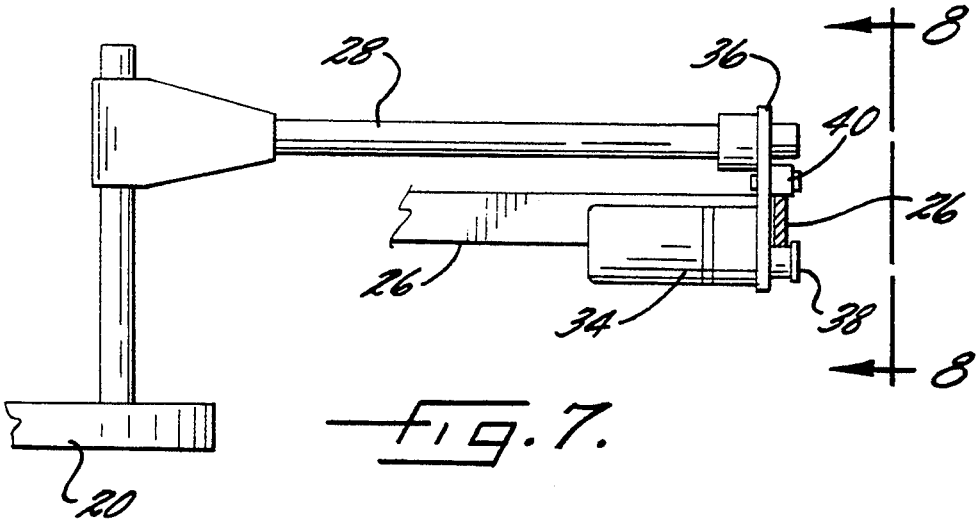
FIG. 7 is an enlarged view, primarily in front elevational, of support and drive components associated with the fan of FIGS. 5 and 6.
Figure 8A:
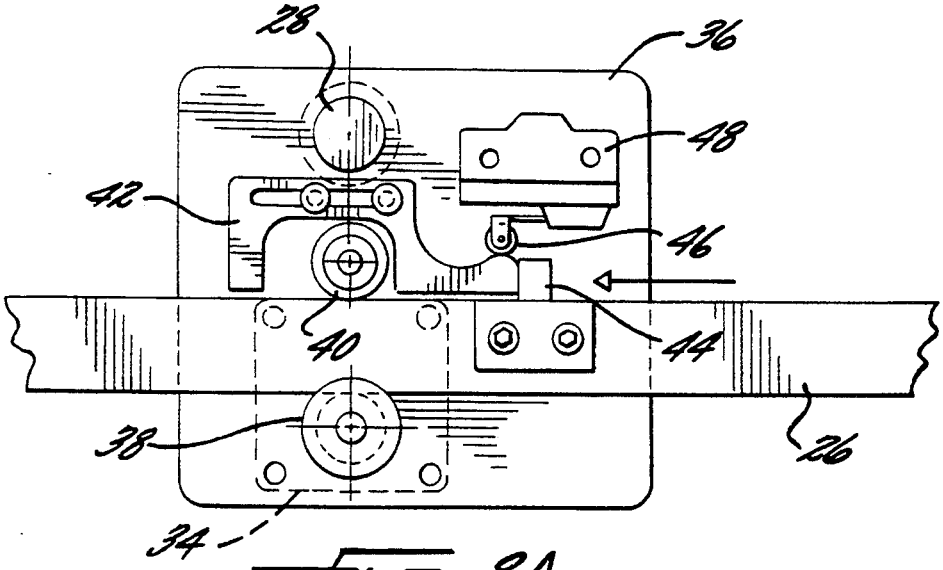
FIG. 8A is a view taken in the direction of the arrows 8—8 of FIG. 7 and showing support, drive, switch and cam members associated with the traveling fan of FIGS. 5 and 6.
Figure 8B:
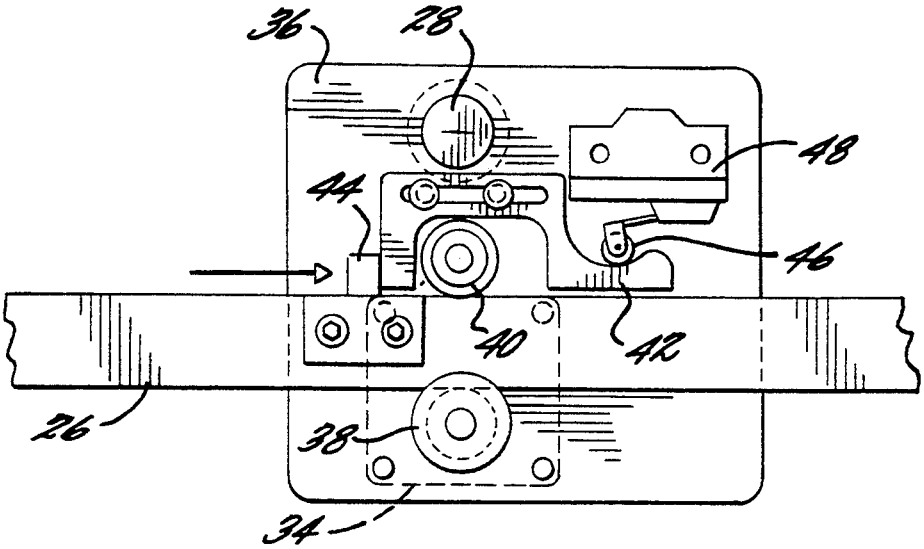
FIG. 8B is a view similar to FIG. 8A, but showing cam, cam actuator and cam follower elements in different positions.
Figure 9:
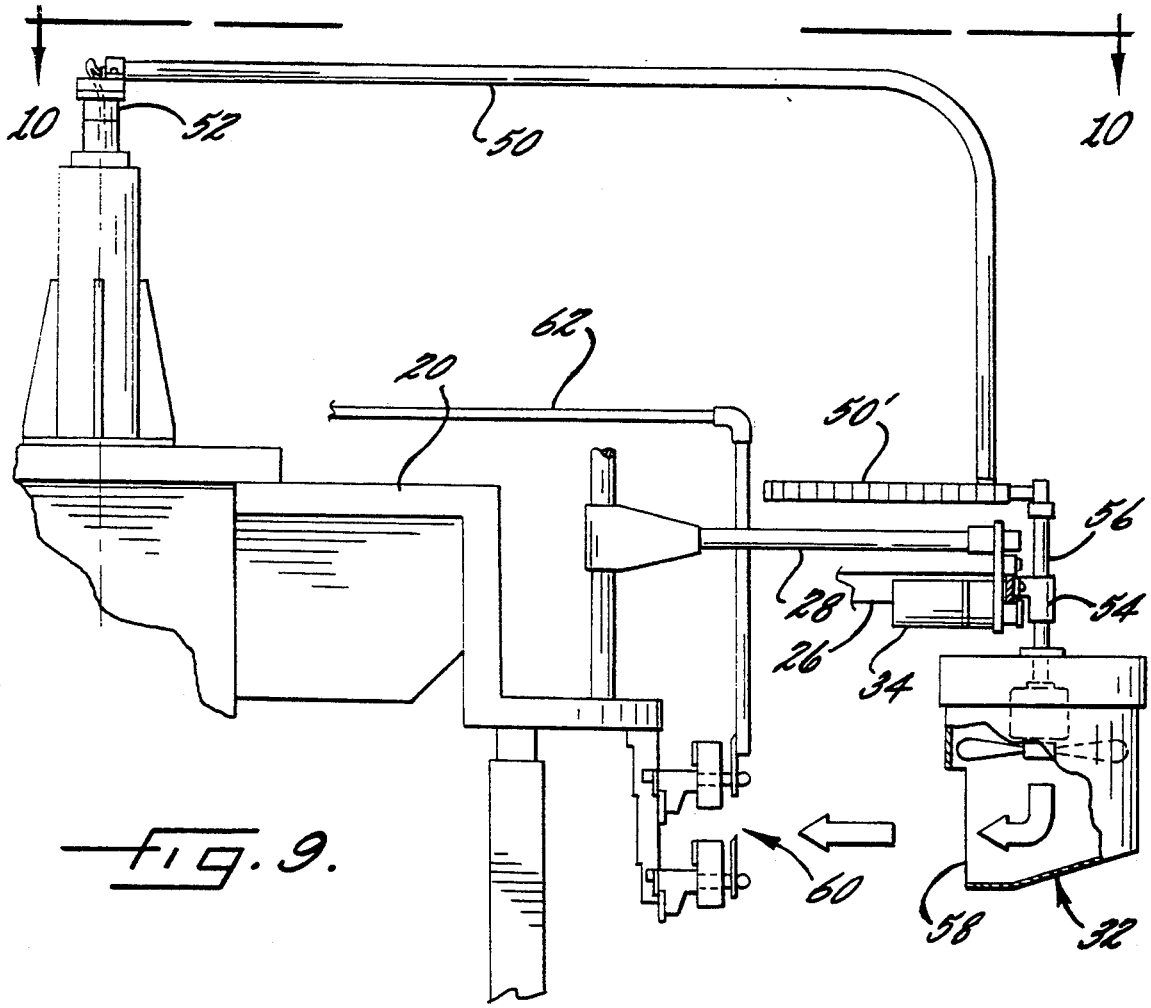
FIG. 9 is an enlarged fragmentary front elevational view of one of the traveling fans and associated support and drive means, and of a conduit and associated means for conducting electricity to the fan.
Figure 10:
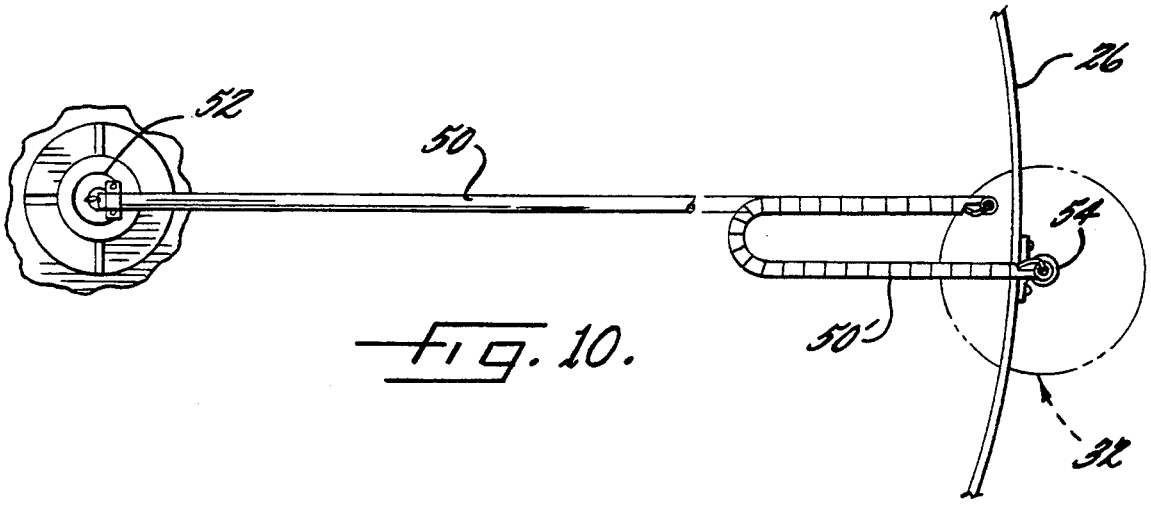
FIG. 10 is a fragmentary top plan view, taken in the direction of the arrows 10—10 of FIG. 9, of fan and fan support components shown in FIG. 9.

As is best shown in FIGS. 5, 6 and 8, each fan 32 is connected to its associated support member 28 by a tubular bracket 54 that receives a vertical shaft 56 that may be moved (upon release of a set screw or other locking element 57) vertically so that its air outlet opening 58 is at an elevation adjacent that of yarn feeding members 60 proximate the downstream ends of pipes 62 that conduct yarn from a creel (not shown) to machine 10. Consequently, when fans 32 are energized and travel around the periphery of machine 10, streams of air pass from the fans to the yarn feeding members 60. As is indicated by the directional arrows in FIG. 1, the air streams from fans 32 entrain fiber waste generated at the members 60 and conduct such waste to a location adjacent the flared open lower end of duct 18. An upwardly directed air stream generated by the fan 24 within duct 18 then conducts the entrained waste removed from the yarn feeding members, along with the fiber waste removed from the knitting section of machine 10, upwardly to and through the upper end of duct 18. The quantity and velocity of the fiber waste entraining air stream passing upwardly to and through duct 18 may be varied by adjusting the vertical position of lower duct section 18'. Although the blade component of fan 24 illustratively is located within upper section 18' of duct 18, the fan might instead be mounted anywhere along the length of duct 18, or even at a location below the lower end of the duct.

The air and entrained fiber waste passing upwardly from the upper end of duct 18 is received within a laterally extending second duct 64 having a downstream end spaced radially outwardly from machine 10. A vertically extending third duct 66 has its upper end releasably connected, as by means of a band 65, to the downstream end of duct 64. In contrast to ducts 18 and 64, which customarily are formed of sheet metal or similar relatively stiff imperforate material, duct 66 is formed of flexible and durable cloth or vinyl material having a multiplicity of small openings therein. The number of openings in the material of duct 66 is preferably within the range of approximately 100–120 per square inch, and more preferably is approximately 110 per square inch. The size of the openings is such as to permit lateral egress of air from duct 66, while preventing or at least minimizing lateral passage of fiber waste from the duct.

The downstream end of duct 66 communicates with and is releasably connected, as by a band 68, to the upper end of a fiber waste collection box 70 located in laterally spaced relationship to machine 10, as shown in FIG. 1. The bands 65, 68 may be elastic, or of the type having cooperating hook and loop members, or of some other type. The front, rear and opposite side walls of box 70 illustratively and preferably have panels of perforate material that is the same as or similar to the material of duct 66, and that functions in the same manner to permit lateral egress of air, but not fiber waste, from the box. The fiber waste entering the open upper end of box 70 passes downwardly through a funnel-shaped member 72, best shown in FIG. 4, adjacent the upper end of the box. Passage of the fiber waste along the downwardly and inwardly sloping surfaces of member 72 and through its central opening 74 compacts the fiber waste, which facilitates its subsequent removal from the box 70.

If the fiber waste passing through duct 66 should tend to adhere to the interior surfaces of the duct, it may be easily dislodged by shaking or "patting" the duct.

Although duct 66 and waste collection box 70 illustratively are both of square cross-sectional shape, they may be of circular or other cross-sectional shape.

While specific embodiments of the invention have been shown and described, this was for purposes of illustration only, and not for purposes of limitation, the scope of the invention being in accordance with the following claims.

We claim:

1. Apparatus for collecting and removing fiber waste generated during operation of a circular knitting machine having a knitting unit, comprising:

generally vertically extending first duct means located above and in general axial alignment with said knitting unit, said first duct means having a lower end adjacent said knitting section and an upper end distal from said knitting section;

fan means for generating fiber waste entraining air streams that pass into said first duct through said lower end thereof, then upwardly through said duct, and then from said first duct means;

second duct means for receiving said fiber waste entraining air streams passing from said first duct means and for conducting said air streams laterally outwardly from said knitting machine;

third duct means for receiving said fiber waste entraining air streams passing from said second duct means, and for downwardly conducting said air streams and therein entrained fiber waste; said third duct means being constructed along at least part of its length of material having a multiplicity of openings therein permitting passage of air laterally from said duct means while restricting lateral passage of entrained fiber waste from said duct means.

2. Apparatus as in claim 1, wherein the number of said openings in said material of said third duct means is within the range of approximately 100–120 per square inch.

3. Apparatus as in claim 2, wherein the number of said openings in said material of said third duct means is approximately 110 per square inch.

4. Apparatus as in claim 1, wherein said first-mentioned duct means has upper and lower sections that are telescopically adjustable relative to each other, and wherein adjustment of said duct sections relative to each other varies the air flow through said duct means.

5. Apparatus as in claim 1, and further including traveling fan means mounted for movement about the periphery of said knitting machine, said fan means producing air streams that conduct therein entrained fiber waste from the periphery of said machine to a location adjacent said lower end of said first duct means.

6. Apparatus as in claim 5, wherein said first duct means has an outwardly flared skirt portion adjacent said lower end thereof.

7. Apparatus as in claim 1, and further including a fiber waste collection box, and wherein said third duct means has a downstream end connected to and communicating with said box.

8. Apparatus as in claim 7, wherein said fiber waste collection box has at least one side wall formed at least in part of perforate material permitting passage of air from said box while restricting passage of said fiber waste from said box.

9. Apparatus as in claim 8, wherein said fiber waste collection box has front, rear and opposite side walls each formed at least in part of said perforate material.

10. Apparatus as in claim 1, wherein said material of said third duct means is flexible.

11. Apparatus as in claim 10, wherein said material of said third duct means is fabric.

12. Apparatus as in claim 10, wherein said material of said third duct means is vinyl.

13. Apparatus as in claim 7, wherein said fiber waste collection box includes means for compacting fiber waste introduced into said box.

14. Apparatus as in claim 13, wherein said means for compacting said fiber waste includes a funnel-shaped member adjacent the upper end of said box.

15. Apparatus as in claim 5, and further including an endless ring connected to and extending about an upper part of said knitting machine, said traveling fan means being connected to said ring.

16. Apparatus as in claim 15, and further including drive means for imparting movement to said ring.

17. Apparatus as in claim 16, wherein said drive means includes a drive motor, and means for reversing the direction of the movement imparted to said ring by said drive motor.

18. Apparatus as in claim 16, wherein said means for reversing the direction of said movement includes a cam member upon said ring and a cam plate engageable with and movable by said cam member.

19. Apparatus as in claim 18, wherein said means for reversing further includes a control switch actuable by movement of said cam plate.

20. Apparatus as in claim 3, wherein said third duct means is constructed substantially entirely of said material.

* * * * *

UNITED STATES PATENT AND TRADEMARK OFFICE

CERTIFICATE OF CORRECTION

PATENT NO. : 5,363,676

DATED : November 15, 1994

INVENTOR(S) : Tsuchiya

It is certified that error appears in the above-identified patent and that said Letters Patent is hereby corrected as shown below:

On title page, after [22] insert

--Related U.S. Application Data

Ser. No. 07/940,512, September 4, 1992
Ser. No. 07/869,460, April 16, 1992--.

On title page, insert the following:

--Cross-Reference to Related Applications--.

Column 3, line 8, "be" should be --10--.

Column 3, line 10, "be" should be --10--.

Column 3, line 13, "be" should be --10--.

Column 3, line 14 "be'" should be --18'--.

Column 3, line 18, "be'" should be --18'--.

Column 3, line 29, "bi-directional" should be --bidirectional--.

UNITED STATES PATENT AND TRADEMARK OFFICE

CERTIFICATE OF CORRECTION

PATENT NO. : 5,363,676

DATED : November 15, 1994

INVENTOR(S) : Tsuchiya

It is certified that error appears in the above-identified patent and that said Letters Patent is hereby corrected as shown below:

Column 4, line 31, "110" should be --110--.

Column 4, line 65, "We claim" should be --I claim--.

Signed and Sealed this

Thirty-first Day of January, 1995

Bruce Lehman

*Attest:*

BRUCE LEHMAN

*Attesting Officer*

*Commissioner of Patents and Trademarks*